United States Patent [19]

Wang

[11] 4,214,836

[45] Jul. 29, 1980

[54] IMPACT PRINT HEAD

[75] Inventor: Cheng H. Wang, Newton, Mass.

[73] Assignee: Digital Equipment Corporation, Maynard, Mass.

[21] Appl. No.: 889,886

[22] Filed: Mar. 24, 1978

[51] Int. Cl.[2] ..... B41J 3/12

[52] U.S. Cl. ..... 400/124; 101/93.05

[58] Field of Search ..... 101/93.05; 400/124; 335/304, 274

[56] References Cited

U.S. PATENT DOCUMENTS

| | | | |
|---|---|---|---|
| 3,876,050 | 4/1975 | Linder | 400/124 |
| 3,896,918 | 7/1975 | Schneider | 400/124 |
| 3,929,214 | 12/1975 | Hebert | 400/124 |
| 3,994,381 | 11/1976 | Hebert | 400/124 |
| 4,000,801 | 1/1977 | Baumeister et al. | 400/124 X |
| 4,044,668 | 8/1977 | Barrus et al. | 400/124 X |
| 4,049,107 | 9/1977 | Murat | 400/124 |
| 4,049,108 | 9/1977 | Giessner | 400/124 |
| 4,136,978 | 1/1979 | Bellinger et al. | 400/124 |

FOREIGN PATENT DOCUMENTS

| | | | |
|---|---|---|---|
| 7607826 | 4/1977 | Netherlands | 400/124 |

*Primary Examiner*—Paul T. Sewell

*Attorney, Agent, or Firm*—Cesari and McKenna

[57] ABSTRACT

An impact print head for a matrix printer employs the usual set of wires slidably mounted in the head which are selectively extended from the working end of the head toward a platen by energizing solenoid actuators. However, in lieu of the usual solenoid strikers, return springs therefor and print wire return springs, a single set of unitary ferromagnetic spring arms connected directly to the print wires and positioned opposite the solenoids mounted in a unitary solenoid frame assembly. Also a shunt plate is mounted in the head and positioned on the opposite sides of the spring arms from the solenoids. The shunt disk and frame assembly shape the magnetic flux pattern from each energized solenoid so that a maximum number of flux lines from each solenoid intercept the associated spring arm to attain maximum dynamic print range and efficiency. Higher print speed may be attained by preloading each spring arm toward its associated solenoid and substituting for the shunt disk, a set of permanent magnets positioned on the opposite sides of the spring arms from their solenoids. Their magnetic field strengths are such as to overcome the self-biases of the associated spring arms so that each spring arm, when quiescent, is spaced from its solenoid and contains appreciable potential energy. When energized, each solenoid produces a field which is opposite to and at least equal in strength to that produced by the corresponding permanent magnet so that the potential energy stored in the associated spring arm is released as kinetic energy which helps to rapidly move the spring arm to promptly extend the associated print wire.

10 Claims, 9 Drawing Figures

IMPACT PRINT HEAD

BACKGROUND OF THE INVENTION

This invention relates to an matrix impact printer. It relates more particularly to an improved print head for such a printer.

An impact printer is one which has a plurality of print elements which can be extended selectively to impact against paper or other web carried on a platen. A web having a transfer coating, such as carbon ribbon, is interposed between the print head and the paper so that when a printing element impacts against the ribbon, a character is printed onto the paper. The most obvious example of an impact printer is a conventional typewriter each of whose printing elements carries an embossed character which is printed onto the paper when that printing element is actuated. Thus a separate printing element is required for each character to be printed.

In a matrix printer, the characters are composed of tiny appropriately positioned dots. These dots are formed by a print head having relatively few identical print elements in the form of thin wires whose corresponding ends are positioned at the working end of the head opposite the platen. The formation of a given character involves alternately extending selected ones of the wires toward the platen and displacing the print head and platen relative to one another. Thus, for example, in a typical matrix printer, the print head may contain a vertical column of seven wires and be movable horizontally relative to the platen five steps for each character location. In other words, each character location may be considered as a 5×7 grid or matrix, with the identity of the character at that location being determined by which of the seven wires in the vertical column are actuated at each of the five horizontal locations in the grid. Since the printing elements used in the print head of a matrix printer are small and lightweight, they have relatively low inertia so that the printer can print at a high rate of speed. As such, matrix printers are often used to print out data from high-speed computers.

In one conventional type of print head of primary interest here, a set of print wires are slidably mounted in the print head along a general direction parallel to the axis of the head. Corresponding ends of those wires are aligned in a vertical column at the working end of the head which is positioned opposite the platen and the usual carbon ribbon and paper are trained between the head and the platen. The opposite ends of the wires, each terminating in an anvil, are distributed relative to the head axis at the opposite end of the head. Associated with each print wire is a solenoid actuator, the actuators being positioned to strike the associated print wire anvils.

The actuators employed in the prior printers of this general type usually comprise an electromagnet or solenoid oriented parallel to the print head axis and a striker pivotally mounted opposite the solenoid and with its end disposed opposite the anvil on an adjacent print wire. When the solenoid is energized, it attracts its striker which thereupon strikes the associated print wire anvil displacing that wire along the print head axis. Thus the print wire is extended momentarily from the working end of the print head and impacts the ribbon and paper to produce a printed dot on the paper.

Each actuator also invariably includes a separate spring for biasing its striker away from its solenoid so that the striker is assured of traveling a sufficient distance to properly impulse the print wire each time the solenoid is energized. Also, known printers of this type provide a separate small coil return spring for each print wire to assure that each wire retracts promptly and completely into the print head following each actuation thereof.

While the prior print heads employing such print wires and actuators are widely used, they are not as efficient as they might be. It is believed that this is because their actuators are characterized by relatively poor magnetic performance and high inertia. Consequently, a relatively large amount of power is required to drive each actuator so that it overcomes its spring bias and causes the associated print wire to impact the paper with sufficient force to print a distinct dot on a reliable basis. Such high power utilization is not only reflected in higher operating cost for the prior printers, but also a considerable amount of that power is dissipated as heat in the print head. That heat adversely affects the components of the head thereby increasing head maintenance costs and shortening the service life of the head.

Some prior heads are also adversely affected because repeated actuations of the print wires cause undue wear of the wire anvils as well as the wire guides that serve to locate the wires in the head. The former problem is due to the repeated impacts of the strikers against the separate anvils. It is believed that the latter wear problem is due to inappropriate arrangements of print wire actuators and wire guides that produce undue bending of the wires along their courses to the working end of the head. Moreover, the print wires in some prior heads are prone to jam because paper and dirt particles invariably accumulate in the head and the separate small coil return springs are unable to overcome the resistance presented by such debris and properly retract the wires. All of these factors further increase head maintenance problems.

Finally, the prior heads are relatively complex and difficult to assemble so that they are expensive to make.

SUMMARY OF THE INVENTION

Accordingly, the present invention aims to provide an impact print head for a matrix printer which has low power consumption and is therefore more efficient than prior comparable print heads of this general type.

A further object of the invention is to provide such a print head whose components are easily made and assembled so that the head is less expensive to make than prior heads of this general type.

Another object is to provide a head of this type which has a relatively great dynamic print range.

A further object is to provide such a head which is characterized by relatively quiet performance.

Yet another object of the invention is to provide an impact print head for a matrix printer which should have a long service life and require minimum maintenance.

Another object of the invention is to provide such a print head which requires a relatively small amount of actuating power to produce high quality characters.

Still another object is to provide a print head of this type which can print at high speed.

Other objects will in part be obvious and will in part appear hereinafter.

The invention accordingly comprises the features of construction, combination of elements and arrangement of parts which will be exemplified in the following detailed description, and the scope of the invention will be indicated in the claims.

Briefly, my impact print head is similar to prior heads of this general type in that it employs a set of small guage print wires slidably mounted in the head so that, using actuators, selected ones of the wires can be extended momentarily from the working end of the head to impact a carbon ribbon and print character-forming dots on paper positioned on a platen under the ribbon opposite the print head.

However, in the present head, the print wire actuators are all mounted on a unitary solenoid frame assembly so that the actuators are distributed properly about the axis of the print head. This arrangement not only enhances head performance but also simplifies its assembly as will be described later. The frame assembly includes a ferromagnetic plate having a peripheral array of spaced-apart ferromagnetic teeth integral with the plate. Projecting out from the plate adjacent each tooth is a pin or rod that functions as a solenoid core. A winding in the form of a spool is slidably received on each pin to complete each actuator solenoid.

Also each actuator includes, in lieu of the usual relatively heavy, rigid striker and ancillary spring, a single, generally L-shaped, light-weight, ferromagnetic leaf spring arm disposed opposite the pole end of the corresponding actuator solenoid. The short leg of the spring arm is anchored to a frame assembly tooth, while the opposite end of the spring arm extends opposite the solenoid and is connected directly to the end of print wire. Since the print wire anvil is replaced by a direct connection to the spring arm, the present head suffers no anvil wear problem. Further, the present construction obviates the need for a separate print wire return spring because the spring arm itself performs that function. This not only simplifies the construction of the print head, but also drastically reduces the incidence of print wire jamming due to dirt build up in the head since the spring arm is quite strong enough to retract the associated print wire even if such debris is present.

While at first glance it might appear obvious to substitute the single ferromagnetic spring arm for the usual striker, return spring therefore and print wire return spring that serve each print wire in the prior heads, such is really not the case. This is because metals having good spring characteristics invariably have poor magnetic characteristics. Thus it is not at all obvious to have the same metal component function both as a spring and the solenoid arm of a high performance print wire actuator. On the contrary, one would think that sufficient impulses would not be imparted by the solenoids to their spring arms for effective printing, at least not without an excessive input power requirement for the head.

In the present head, however, provision is made for shaping the magnetic flux lines produced by each solenoid when it is energized so that a maximum number of those lines are intercepted by the associated spring arm. More particularly, a special magnetic shunt plate is positioned on the opposite sides of the spring arms from the frame assembly teeth and solenoids comprising the actuators. The plate provides a shunt path for the magnetic fluxes produced by the solenoids when energized while the teeth provide separate magnetic return paths for each solenoid so that the magnetic field produced by one actuator, does not affect adjacent actuators. The result is that the actuators consume relatively little power while achieving high magnetic performance so that the print head can operate efficiently while still printing high-quality characters.

The present head is advantaged also in that the print wire actuators and the wire guides in the head are so formed and distributed about the axis of the head that the wires suffer a minimum amount of distortion on their various courses through the head, thereby minimizing the wire guide wear that plagues prior matrix print heads. Furthermore, this same form and arrangement permits all of the print wires to follow the same shape curve through the print head so that each print wire, when inserted into the actuator end of the head, will automatically find its way through the correct openings in the various guides spaced along the head so that its end arrives at the appropriate location in the column at the working end of the head. Needless to say, then, this feature greatly facilitates assembling the head, thereby reducing its initial cost.

In another head embodiment, higher print speeds are achieved by mounting the spring arm and solenoid comprising each actuator such that the spring arm is preloaded toward the solenoid. Then in lieu of the shunt disk, permanent magnets are positioned on the opposite sides of the spring arms from the solenoids. The field strength of each permanent magnet is such as to overcome the self-bias of the opposing spring arm so that that spring arm is drawn against a dead rubber stop and away from the associated solenoid. Consequently, in its quiescent state, each spring arm contains appreciable potential energy.

Current is applied to each actuator solenoid in a direction such that is has the opposite polarity from the permanent magnet pole opposite that solenoid, and a field strength which at least cancels the field produced by that permanent magnet. Resultantly, the potential energy in the intervening spring arm is immediately converted to kinetic energy so that the arm moves swiftly toward its solenoid at a rate proportional not only to the field strength of the solenoid, but also to the potential energy in the spring arm.

Then, upon deenergization of each actuator solenoid, the associated permanent magnet pulls the intervening spring arm back to its stop thereby immediately retracting the corresponding print wire into the head, the stop serving to minimize arm rebound and noise. Thus the actuators in this print head embodiment can drive the print wires faster and with greater force using less power than can the actuators found in prior comparable print heads of this general type.

Finally, since both print head embodiments require less power to print satisfactorily, less energy is dissipated in the heads as heat. This is reflected in lower maintenance costs and longer life expectancies for the heads.

BRIEF DESCRIPTION OF THE DRAWINGS

For a fuller understanding of the nature and objects of the invention, reference should be had to the following detailed description, taken in connection with the accompanying drawings in which.

DESCRIPTION OF THE PREFERRED EMBODIMENTS

Figure 1:
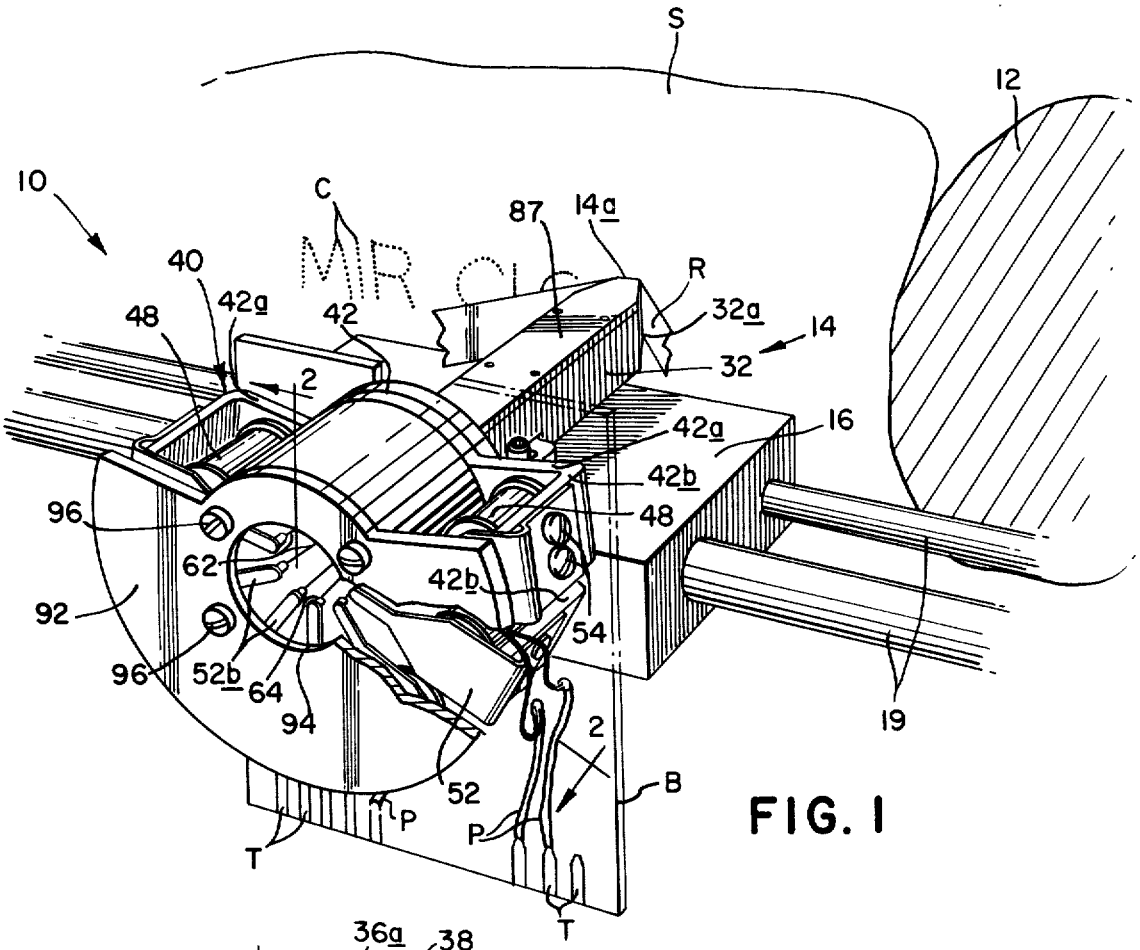
FIG. 1 is a fragmentary perspective view with parts broken away of a matrix printer employing an impact print head made in accordance with this invention.

Turning now to FIG. 1 of the drawings, a printer shown generally at 10 includes the usual platen 12 supporting a sheet of paper S. The illustrated platen 12 is cylindrical. However, it could just as well be flat. Positioned directly opposite platen 12 is an impact print head shown generally at 14. The print head 14 is suitably mounted on a carriage 16 so that the front or working end 14*a* of the head is positioned directly opposite platen 12 and the paper sheet thereon. Carriage 18 is movable along a pair of spaced-apart guide rods 19 oriented parallel to the axis of platen 12 and the usual means (not shown) normally employed in printers of this type may be used to properly position the carriage 16 along guide rods 19.

Also conventional transfer means such as a carbon ribbon R is trained around the head working end 14*a*. The ribbon may be payed out an taken in by spools. More preferably, however, the ribbon is drawn from a cassette (not shown) positioned on carriage 16 adjacent head 14. Since the ribbon feed is not part of this invention, it will not be detailed here.

The various electrical connections to the head 14 are conveniently made via a printed circuit board B secured to the head or to carriage 16. The board has printed conductors P extending between head 14 and a set of terminals T arranged to plug into a corresponding set of female terminals on a flexible harness (not shown).

As is the case with such matrix printers, head 14 is controlled as it is being moved relative to platen 12 to impact the paper carried on the platen through the ribbon R to transfer printed characters C composed of a multiplicity of tiny dots. For reasons of clarity, the characters and the dots forming them are shown spaced apart further than is actually the case. Utilization of the head 14 in printer 10 enables the printer to print reliably distinct characters at high speeds. Accordingly, when used in conjunction with a data processing system, the printer can print data read from the system at a maximum rate of speed. Still, however, for reasons to be discussed presently, the print head 14 is inexpensive to make and assemble and very efficient so that it can accomplish the foregoing using a minimum amount of power. This efficiency is also reflected in a lower operating cost.

Figure 2:
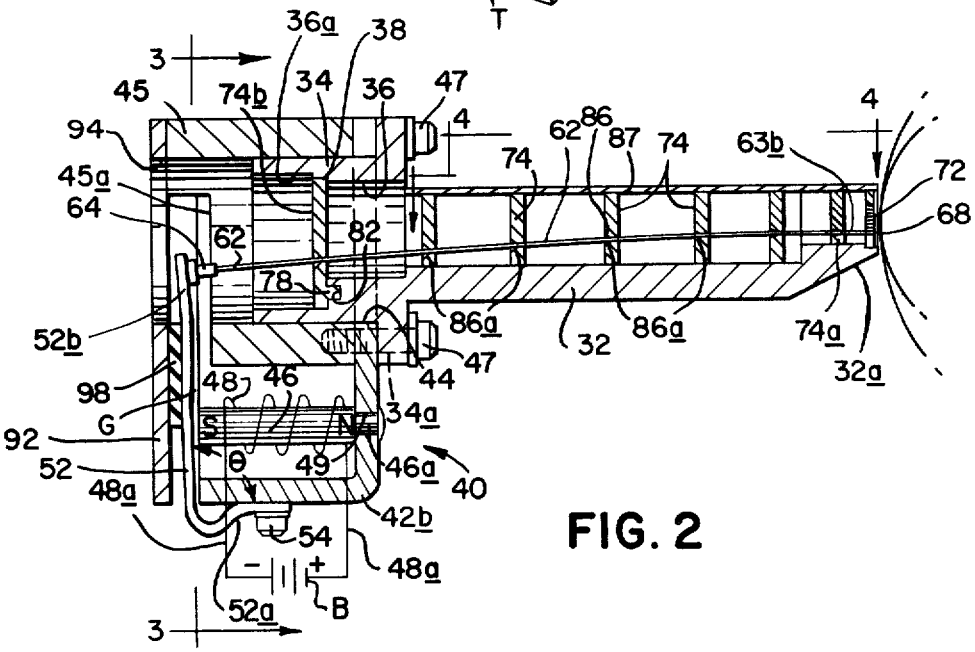
FIG. 2 is a sectional view along line 2—2 of FIG. 1.
Figure 3:
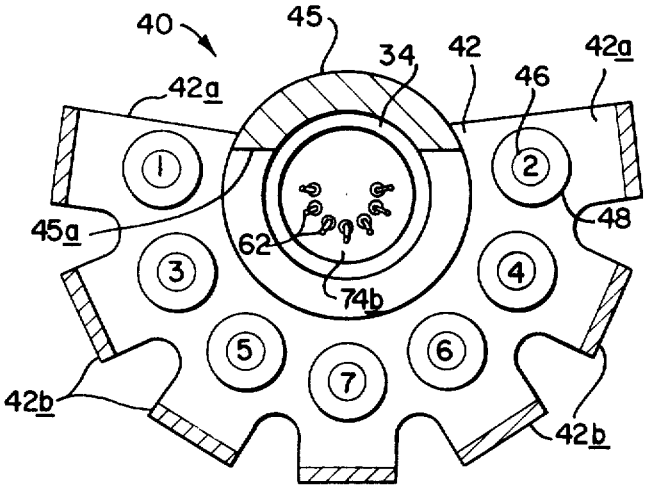
FIG. 3 is a sectional view along line 3—3 of FIG. 2.
Figure 4:
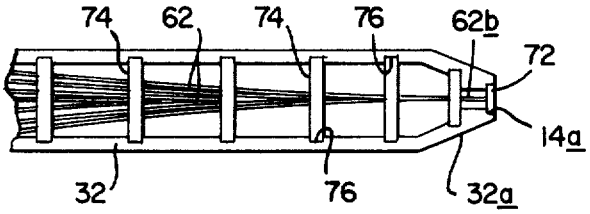
FIG. 4 is a plan view along line 4—4 of FIG. 2 with parts broken away.

Turning now to FIGS. 2 to 4, head 14 comprises an elongated, generally rectangular housing 32. The housing is open-ended and its top is open as well. Housing 32 is tapered at one end 32*a*, becoming narrower to form the head working end 14*a* which, as best seen in FIG. 4, is a narrow rectangle. The opposite end of housing 32 terminates in a cylindrical tube 34. The tube bore 36 opens into housing 32 and it is more or less coaxial with the housing. Bore 36 is counterbored at 36*a* forming an annular shelf 38 midway along tube 34. Also tube 34 is formed with a radial flange 34*a* at its inboard end.

Engaged over the tube 34 is a unitary solenoid frame assembly shown generally at 40. The assembly comprises a generally semi-circular ferromagnetic stamped metal plate 42 having an opening 44 which receives tube 34. Plate 42 is oriented on the tube with its straight edges 42*a* uppermost. The lower, curved edge of plate 42 is provided with a set of seven spaced-apart, rearwardly extending integral teeth 42*b* that extend somewhat beyond the end of tube 34. The plate is retained there by a cylindrical sleeve 45 engaged on tube 34 and the plate and sleeve are anchored by set screws 47 extending through openings in tube flange 34*a*, and in the plate, which screws are turned down into appropriate threaded passages in the sleeve end.

As best seen in FIG. 3, secured to plate 42 inboard of teeth 42*b* is a set of electromagnets or solenoids. In the illustrated head, there are seven such solenoids numbered 1 to 7 corresponding to the number of vertical dots in a typical 5×7 character matrix or grid. If the number of vertical character-forming dots in the matrix is to be eleven, which is another commonly used number, then there would be eleven solenoids secured to plate 42, as well as eleven teeth 42*b*.

The solenoids 1 to 7 are identical. Therefore, for reasons of clarity, we have only shown solenoid 4 in detail in FIG. 2. As seen from that figure, it comprises a ferromagnetic core or pin 46 one of whose ends 46*a* is received in a suitable opening 49 in plate 42 and is upset, riveted or otherwise secured there. The opposite end of the core is even with the adjacent tooth 42*b*. Core 46 is encircled by a winding 48 in the form of a spool (see FIG. 1). During assembly of the head, the spool is slid into the core 46 and retained there by a suitable cement. The winding 48 (shown diagramatically in FIG. 2), is arranged so that when connected via leads 48*a* to a suitable current source illustrated as a battery B, it magnetizes core 46 to form north (N) and south (S) poles at the opposite ends of the core as shown. As best seen in FIGS. 1 and 3, the solenoids 1 to 7 are secured to plate 42 in a generally semi-circular array. Furthermore, their winding leads 48*a* are all connected via printed circuit board paths P to the current source B, so that the free ends of cores 46 will all have the same polarity, e.g., south.

Referring to FIGS. 1 to 3, associated with each solenoid 1 to 7 is a flexible, resilient, generally L-shaped ferromagnetic spring arm 52. The arm material should have good spring characteristics and fairly good magnetic properties, e.g., 1095 blue steel. The short leg 52*a* of each arm 52 is relatively wide and it is engaged against the outside wall of the the adjacent tooth 42*b* so that the arm 52 overlies the free end of the solenoid next to that tooth. The arm legs 52*a* are secured to teeth 42*b* by pairs of set screws 54 extending through the arm and turned down into appropriate threaded openings in the teeth. Thus, the set of arms 52 form a generally semicircular array, with the arms extending radially inward, sleeve 45 being cut back at 45*a* (FIGS. 2 and 3) to accommodate them.

Also as best seen in FIG. 1, the arm ends radially inboard of the associated solenoids are tapered to form very narrow extensions or fingers 52*b* which are closely grouped in a semicircle.

Turning now to FIGS. 1 to 4, head 14 also contains a set of seven print wires 62, each having one end 62*a* extending into a tiny sleeve 64 (FIGS. 1 and 2) attached to arm end 52*b* and being permanently secured there by solder, cement or other suitable means. The opposite end 62*b* of each wire slidably projects through one of a set of seven vertically spaced openings 68 in a jewel bearing 72 secured in the narrow end of housing 32 at the head working end 14*a* by epoxy resin or other suitable means.

Since the wire ends 62*a* are arranged in a semicircle while the opposite wire ends 62*b* are positioned in a vertical column, it is obvious that the wires are deformed to some extent from one end to the other. The wires 62 are guided along their separate courses in housing 32 by a set of seven bulkheads 74 spaced along the housing. Each bulkhead is keyed into slots 76 formed in the side walls of housing 32 and the bulkheads are appropriately dimensioned to seat tightly in the housing. Thus the bulkhead 74*a* closest to bearing 72 is a relatively narrow and short rectangle, while the bulkhead 74*b* (FIGS. 2 and 3) seated on shelf 38 inside tube 34 is circular and has a laterally extending finger 78 that projects into a passage 82 in tube 34 to preserve the orientation of that bulkhead. The bulkheads are formed with arrays of tiny passages 86 for slidably receiving the print wires 62, with the locations of passages 86 in the bulkheads differing to accommodate the print wires as they extend from one end of the housing to the other.

The top of housing is closed by a conveniently removable cover plate 87 (FIGS. 1 and 2).

The semicircular distributions of the solenoids 1 to 7 and the spring arms 52 as well as the distributions of the openings 86 in the bulkheads 74 are selected to minimize the lengthwise bending or distortion of the print wires 62. More particularly, the array of point wires progresses from a semicircular shape (FIG. 3) to more progressively acute V-shapes until finally the wire ends 62*b* toward the working end of the head interleave or mesh to form a vertical column (FIG. 4). In other words, if the column of wire ends 62*b* at the working end of the head are numbered as wires 1 to 7 from top to bottom, the corresponding wire ends 62*a* arranged in a semicircle at the opposite end of the head as seen in FIG. 3 are associated with solenoids 1, 3, 5, 7, 6, 4, 2 respectively, proceeding counterclockwise around the semicircle as shown in that figure.

Most preferably, the print wire courses through the head follow the very same shape curve so that no one wire is bent more than another and all are bent a minimum amount. This arrangement contrasts sharply with those in other prior print heads whose solenoids and internal wire ends are arranged in an inverted trapezoid or other such shape requiring extreme distortion of at least some of the print wires along their courses to the working end of the head. Resultantly, the present print head suffers a minimum amount of wear due to sideload forces at the points where the print wires pass through the bearing 72 and bulkheads 74. Consequently, the bearing and bulkheads have a relatively long useful life before requiring replacement which of course minimizes maintenance costs and head downtime.

Furthermore, since the print wires 62 all curve the same minimum amount along their paths through the head, when inserted into the head from the actuator end, they thread themselves automatically through the proper openings 86 in the bulkheads 74 and bearing 72, particularly if the openings presented to the wires are flared as shown at 86*a* in FIG. 2. As seen there, these flares can be less pronounced toward the working end of the head since the wires are less distorted there.

Referring now to FIGS. 1 and 2, positioned at the free end of sleeve 45 opposite the spring arms 52 is a plate 92 made of a ferromagnetic material. This plate 92 functions as a backstop member and as a so-called magnetic shunt plate as will be described presently. The plate has a central opening 94 in register with the bore of sleeve 45 and it is secured to the sleeve by appropriately spaced set screws 96 extending through the plate and turned down into threaded passages provided in the end of sleeve 45. A thin sheet 98 of dead rubber, adhered to the inside wall of plate 94, extends opposite arms 52. This sheet minimizes arm 52 rebound and helps to quiet the head when in use. Each arm 52 normally resides against sheet 98 at an angle $\theta$ of approximately 93° to provide a suitably wide gap G between the relaxed spring arm and its associated solenoid core.

Plate 94 is made of a metal such as cold rolled steel having good magnetic properties. The disk functions to help shape the magnetic field produced by each solenoid when it is energized so that there is a maximum flux density in the gap G between each arm and its solenoid. The ferromagnetic tooth 42*b* to which each arm 52 is attached helps in this same respect by providing a magnetic return path for each solenoid and magnetically isolating adjacent solenoids so that each actuator is unaffected by the operation of adjacent actuators.

Thus, even though each spring arm 52 itself may not have superior magnetic properties, as long as the shunt disk 92 is present, the magnetic flux developed in gap G adjacent the arm is sufficiently strong that the arm is attracted toward its solenoid core 46 relatively swiftly and with appropriate force. Consequently, with relatively low input power, the head 14 still prints at a relatively fast rate and its print wires 62 impact the ribbon R (FIG. 1) with sufficient force to reliably print distinct, character-forming dots on paper positioned between the head working end 14*a* and platen 12. Moreover the gap G can be relatively wide. Consequently, there is no need to design the head so that gaps can be adjusted to enable the head to print both single and multiple copies. In the present head a fixed gap G width of about $0.025 \pm 0.005$ inch suffices for up to four copy sets. Thus the present head has a wide dynamic print range.

Figure 6:
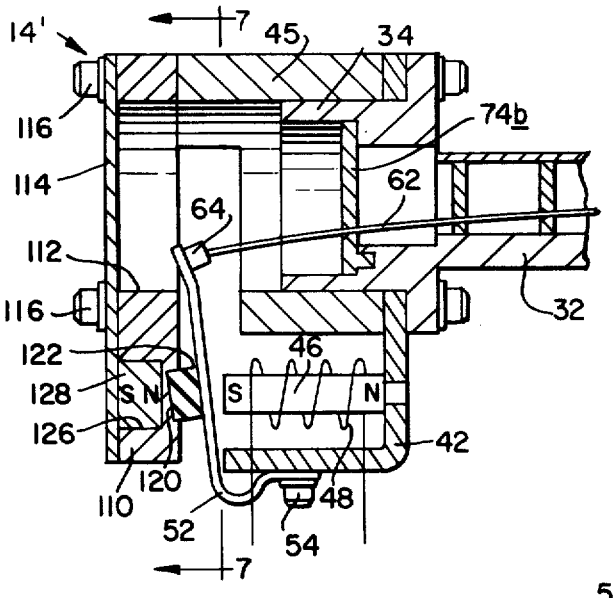
FIG. 6 is a view similar to FIG. 2 illustrating a modified embodiment of the print head that may be used in the FIG. 1 printer.
Figure 7:
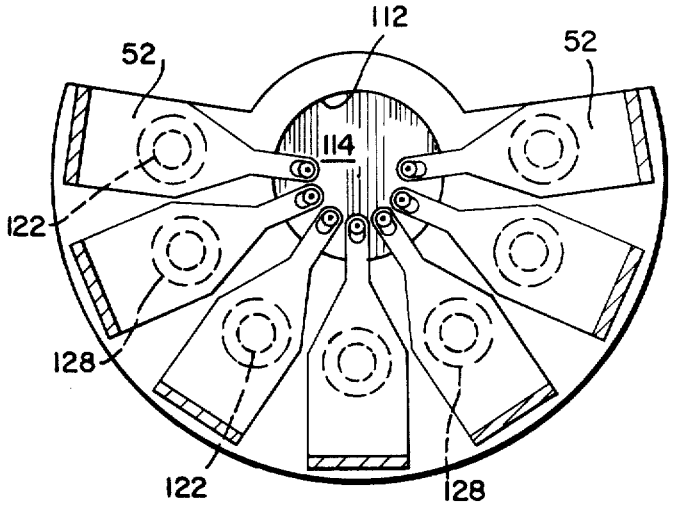
FIG. 7 is a sectional view along line 7—7 of FIG. 6.
Figure 8:
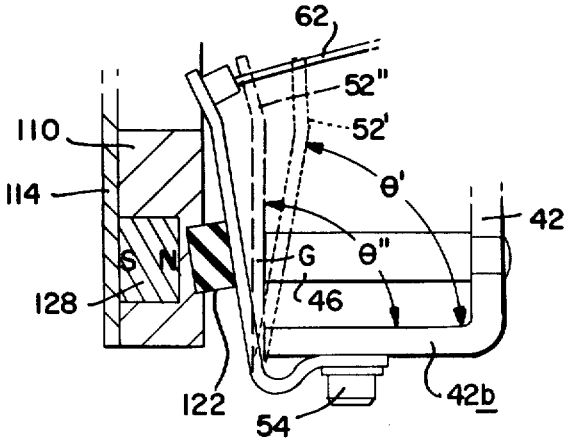
FIG. 8 is a fragmentary sectional view showing an actuator used in the FIG. 6 print head in greater detail.

FIGS. 6 to 8 depict another head embodiment shown generally at 14' capable of higher printing speeds than are obtainable with conventional heads of this type, e.g. 200 versus 120 characters per second when printing bidirectionally. Head 14' is very similar to head 14 so that only part of its needs to be shown and the illustrated parts that are common to both carry the same numerals.

In lieu of plate 92, head 14' has a discoid backstop member 110 made of a nonferromagnetic material such as aluminum. Member 110 is formed with a central opening 112 registering with the bore of sleeve 45. Also a discoid nonmagnetic cover 114 is positioned over member 110 to close off the end of opening 112. The cover 114 and backstop member 110 are secured to sleeve 45 by set screws 116 extending through appropriate openings in the cover and backstop member and turned down into threaded passages in the end of the sleeve.

Backstop member 110 is formed with a recess or dimple 120 opposite each spring arm 52'. Each dimple 120 is canted or angled so that its bottom surface lies more or less parallel to the spring arm. Secured by epoxy or other suitable means in each dimple 120 is a small discoid stop 122 made of a non-resilient material such as dead rubber to minimize arm rebound and noise.

Each stop projects out from member 110 toward its associated arm to an extent such that it more or less touches the arm when the arm is in its quiescent or unactuated position illustrated in FIG. 6.

A second set of recesses 126 are formed in the opposite side of member 92. Each recess 126 is positioned directly opposite a dimple 120 and these recesses are somewhat larger in diameter than the dimples. Situated in each recess 126 is a cylindrical permanent magnet 128 with the magnet 128 and its opposite stop 122 being coaxial and concentric with the associated solenoid core 46. Magnets 128 are quite strong being made of samarian cobalt or other rare earth cobalt. Furthermore, each magnet 128 is arranged so that its end nearest to the solenoid has a polarity opposite that of the solenoid. Thus in the head illustrated in FIG. 6, which has the south pole of each solenoid facing its spring arm, the associated permanent magnet 128 is positioned with its north pole facing that same arm.

Referring now to FIG. 8, in head 14', each spring arm 52' is preloaded when it is installed in the print head. More particularly, the arm 52' is formed so that before installation when the arm is in its unstressed state, it makes an angle $\theta'$ less than 90° (e.g., 88°) relative to its short leg as shown in dotted lines in FIG. 8. Then when the spring arm is secured to tooth **42*b* by screws 54, it is forced to assume an angle $\theta''$ of 90° relative to that leg by engagement against the end of its solenoid core 46 as shown by the dashed line in FIG. 8. Normally in this position, there would be no gap between the spring arm and the core 46 so that the arm could not move upon energization of the solenoid. However in the present head, the adjacent permanent magnet 128 attracts the spring arm 52' to its stop 122 as shown in solid lines in FIG. 8, creating an appreciable gap G between the spring arm and the solenoid core 46. Thus, each spring arm 52' is biased by the magnetic field from the associated permanent magnet 128 to permit movement of the arm from its solid line position to its dashed line position in FIG. 8. Of course, the length of each print wire 62 is such that when the corresponding spring arm 52' is in its solid line position, the end 62*b* of the print wire is retracted into the head as shown in FIG. 2. On the other hand, when each spring arm is urged toward its dashed line position, the end 62*b* of the attached print wire 62 is projected out beyond bearing 72 so as to forcably contact the transfer ribbon R trained around the head working end 14*a* as described in connection with FIGS. 1 and 2**.

The unusually fast response of the print head 14' is due to the fact that even though each arm is biased away from its solenoid by a magnet 128, it also is preloaded toward that solenoid. Consequently, the arm contains an appreciable amount of potential energy. Thus when the associated solenoid is energized, the polarity and field strength of the solenoid is such as to at least cancel the magnetic field produced by the associated magnet 128. Resultantly, the energy available to move the arm comprises not only the magnetic energy created in gap G by the solenoid, but also the potential energy stored in the arm itself which is converted immediately to kinetic energy when the associated solenoid is energized. In other words, the forces produced by the spring and solenoid supplement one another to move the arm. Since a large percentage of the force available to move the arm and print wire derives from the potential energy stored in the arm, the fact that the arm is not made of a material having superior magnetic properties for attraction to the solenoid does not adversely affect the fast operation of the head.

Figure 5A:
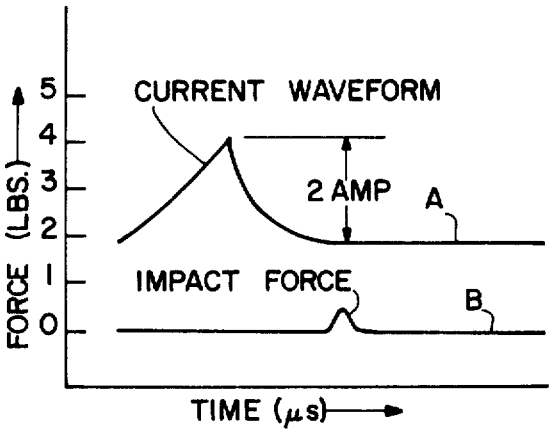
FIGS. 5A and 5B are graphical views that help to explain the operation of my print heads.
Figure 5B:
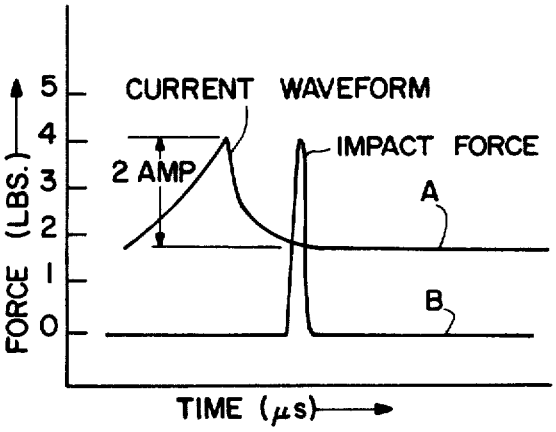

Thus each arm 52' moves from its solid to its dashed line position extremely rapidly so that for given input power, it impulses the attached print wire 62 with a force far greater than would be the case if the arm were not so preloaded. A comparison of the waveforms in FIGS. 5A and 5B graphically illustrates this dramatic improvement. FIG. 5A shows the results obtained from a print head such as shown in FIG. 2 whose arms 52 were not preloaded and biased away from their solenoids by magnets 128. FIG. 5B shows the results obtained from a print head employing preloaded arms just described. In each case the arm made an angle of 93° relative to its short leg when positioned as indicated in solid lines in FIG. 8, i.e., when its associated solenoid was deenergized. In both cases, a current of two amps was applied to the solenoid for the same period as shown by the waveforms A in FIGS. 5A and 5B. The waveforms B in these figures show the impact force of the print wire 62 against a platen. As seen from waveform B in FIG. 5A, the unpreloaded arm produced a print wire impact force of approximately three-quarters of a pound, whereas FIG. 5B shows that the arm, when preloaded and biased by a magnet 128 as described above, developed a print wire impact force of over four pounds. Put another way, the head 14' can achieve the same printing impact force as a head having unpreloaded, unbiased spring arms with four times less solenoid actuating current. It is clear, then , that head 14' results in a drastic increase in the speed and efficiency of impact print heads. Even higher impact forces can be obtained by increasing the arm preload by reducing the initial arm angle $\theta'$ and increasing the strength of its magnet 128.

It will be appreciated from the foregoing, then, that print heads made in accordance with this invention, greatly increase the efficiency of matrix printers while lowering their capital and maintenance costs. As a result, these printers can be incorporated into a data processing system to print data read from a computer reliably and at a rate of speed at less expense than was possible heretofore. Therefore, these printers should find wide application in the data processing industry.

It will also be seen that the objects set forth above among those made apparent from the preceding description are efficiently attained, and since certain changes may be made in the above constructions without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described.

I claim:

1. An impact print head for a matrix printer of the type including a housing, a set of print wires extending along the housing, means for slidably positioning the print wires in the housing, a set of actuators mounted on a frame assembly for moving the print wires between respective extended and retracted positions, each actuator including a solenoid connected to the frame assembly and a spring arm positioned opposite the solenoid and being connected to the frame assembly, said frame assembly, spring arm and solenoid comprising an electromagnetic circuit, the improvement wherein means are provided for preloading each spring arm toward its associated solenoid and a permanent magnet is associated with each spring arm and positioned outside the electromagnetic circuit including that spring arm for biasing each preloaded spring arm away from its associated solenoid so as to create a gap between said arm and said solenoid, the polarities of the magnetic pole and solenoid pole on opposite sides of each spring arm upon energization of the solenoid being of the opposite sense so as to maximize the magnetic flux density in said air gap whereby the energized solenoid exerts maximum pulling force on the spring arm which force is supplemented by the force due to the preloading of that spring arm.

2. The print head defined in claim 1 wherein each spring arm is a thin generally L-shaped leaf spring with its short leg being connected to the housing and its long leg extending to the opposite side of the solenoid being connected to the print wire.

3. The print head defined in claim 1 and further including a set of print wire guides spaced along the housing, each said guide having an array of openings for slidably receiving a different one of said print wires so that each print wire extends through a unique series of openings in said guides in its course between its associated spring arm and the working end of the head.

4. The print head defined in claim 3 wherein the openings in each said unique series of openings are positioned so that all of said print wires are curved substantially the same amount between their ends.

5. The print head defined in the claim 3 wherein the openings in the print wire guides are flared to facilitate threading each print wire through its unique series of guide openings when assembling the head.

6. The print head defined in claim 1 wherein each solenoid comprises:

A. a ferromagnetic pin having one end anchored to the frame assembly,

B. a wire spool slidably received on the pin, and

C. means for securing the spool on the pin.

7. The print head defined in claim 1 wherein

A. said frame assembly is made of a ferromagnetic material,

B. is formed with a peripheral array of spaced-apart ferromagnetic teeth,

C. said one end of each said spring arm is secured to a different one of said teeth, and D. each said solenoid is anchored in said frame assembly so that said frame assembly and its teeth provide a magnetic return path for each solenoid so that the field produced by one actuator does not affect an adjacent actuator.

8. The print head defined in claim 1 and further including impact absorbing means positioned between said biasing means and said spring arms so as to cushion said arms when they move away from their respective solenoids.

9. The print head defined in claim 1 and further including a printed circuit board connected to said head, said board having A. a set of terminal strips for connecting to a current source, and B. printed conductive paths extending between said terminals and said solenoids.

10. An impact print head for a matrix printer of the type including an elongated housing, one end of said housing constituting the working end of the head, a multiplicity of elongated print wires positioned in the housing, corresponding first ends of said wires being arranged in a selected configuration at said one end of the housing, each said wire being slidable individually between a first position wherein its said first end is retracted into said one housing end and a second position wherein its said first end projects from said one housing end, means in the housing associated with the opposite ends of said wires for moving said wires between their said positions, said moving means including an array of solenoids mounted in the head, the number of solenoids corresponding to the number of print wires, a set of armatures made of ferromagnetic material, each armature having one end secured to the head adjacent a solenoid and its opposite end positioned opposite said opposite end of a print wire, an intermediate portion of each armature spanning and being spaced from its adjacent solenoid core end so that when the solenoid is energized momentarily, the spanning armature is pulled toward the solenoid so as to urge the associated print wire momentarily to its second position, the improvement wherein magnetic shunt means are spaced from each armature on the opposite side thereof from the associated solenoid for concentrating the magnetic field produced by said solenoid when energized so that a maximum number of flux lines are intercepted by the armature spanning said solenoid whereby the solenoid pulls the armature toward it with maximum pulling force thereby imparting maximum printing energy to the associated print wire.

* * * * *